United States Patent [19]

Ditto

[11] Patent Number: 4,555,100

[45] Date of Patent: Nov. 26, 1985

[54] FRICTION LOCKING HAND CLAMP

[76] Inventor: Joseph R. Ditto, 3440 Helix St., Spring Valley, Calif. 92077

[21] Appl. No.: 583,319

[22] Filed: Feb. 24, 1984

Related U.S. Application Data

[63] Continuation of Ser. No. 385,929, Jun. 7, 1982, abandoned, which is a continuation-in-part of Ser. No. 266,664, May 26, 1981, abandoned.

[51] Int. Cl.[4] ..... B25B 1/02

[52] U.S. Cl. ..... 269/166; 269/285; 269/286

[58] Field of Search ..... 269/166, 165, 171, 171.5, 269/285, 286, 279, 280, 283, 281–282, 284; 81/180 B; 428/495, 517, 519, 521; 524/451, 584

[56] References Cited

U.S. PATENT DOCUMENTS

| | | | |
|---|---|---|---|
| 1,188,332 | 6/1916 | Sharp | 269/283 |
| 1,500,795 | 7/1924 | Bramhorst | 269/283 |
| 1,751,620 | 3/1930 | Clarke | 269/166 |
| 2,104,217 | 1/1938 | Barnes | 16/2 |
| 2,199,949 | 5/1940 | Davis | 269/166 |
| 2,487,997 | 11/1949 | West | 269/166 |
| 2,510,077 | 6/1950 | Coffman | 269/166 |
| 2,877,815 | 3/1959 | Fonken | 269/171 |
| 2,886,080 | 5/1959 | Rappeport | 269/280 |
| 4,066,250 | 1/1978 | Campbell | 269/168 |
| 4,084,803 | 4/1978 | Beekemkamp | 269/91 |
| 4,202,540 | 5/1980 | Neff | 269/166 |

FOREIGN PATENT DOCUMENTS

| | | | |
|---|---|---|---|
| 234610 | 7/1964 | Austria | 269/166 |
| 15465 | of 1895 | United Kingdom | 269/166 |
| 1376105 | 12/1974 | United Kingdom | 269/171 |

*Primary Examiner*—Robert C. Watson

*Attorney, Agent, or Firm*—Brown, Martin & Haller

[57] ABSTRACT

A clamp incorporating two opposed jaws having resilient pads affixed in way of their gripping surfaces. A first jaw is fixed on a pair of spaced slide rods. The slide rods are held by their being fixed in a clamp arm in a parallel relationship. A second clamp arm is received for slideable movement on the slide rods. A force applied between the slide rods, will cause the clamp arms to move together until they engage an object to be clamped. Further pressure will allow the desired clamping pressure to be achieved. When the pressure is released, the clamping pressure will be maintained by the frictional engagement between the bearing surfaces in the sliding clamp arm and the metal slide rods. Release is achieved by force on the sliding clamp arm in the direction opposite to that used to achieve clamping.

6 Claims, 10 Drawing Figures

FRICTION LOCKING HAND CLAMP

REFERENCE TO RELATED APPLICATIONS

This is a continuation of application Ser. No. 385,929, filed June 7, 1982, now abandoned, which is a continuation-in-part of my copending application Ser. No. 266,664, filed May 26, 1981, now abandoned.

BACKGROUND OF THE INVENTION

Various devices have long been applied for clamping small and large parts to facilitate work operations to be performed on the parts. For example, in the building of model airplanes and similar hobbies, it is necessary to clamp parts for gluing, sawing, sanding, etc. Various spring loaded clamps have been employed; however, they are typically limited in that the clamping results from action about an axis spaced from the jaws, and therefore, such clamps do not have parallel jaw surfaces. Screw clamps may be employed, but it is difficult to regulate the amount of force applied to delicate parts, and the adjustment of the clamp is slowed by the fact that it must be rotated many turns to move the jaws to a new clamping position.

Therefore, to obtain a wide adjustability, and parallel clamping jaws, various sliding clamping devices have been proposed. U.S. Pat. No. 2,510,077 is typical of such devices. In this device, the clamping force is transmitted to rods on which the jaw slides, causing a bending action, and therefore, locking the device in position. However, to release the device, it is necessary to straighten the rods and this requires a two-handed operation, and for some sizes, may be difficult for a single individual to accomplish. Since the rods must be made sufficiently flexible to cause the bending engagement, they cannot have sufficient strength to tolerate high clamping pressures and still be easily operated. Lastly, to accomplish clamping at a particular pressure, it may be necessary to initially apply more than that amount of pressure to the jaws, and therefore, to the clamped object. In some instances, the clamped object can be damaged by the excessive forces necessary to set the jaws.

It is, therefore, desirable to have a clamp with sliding jaws where the force necessary to establish the clamping action does not exceed the sustained clamping force. Such a clamp is particularly desired where the clamping force can be sustained over long periods of time.

SUMMARY OF THE INVENTION

In an exemplary embodiment of the invention, the deficiencies of prior art devices are overcome in a new a simplified friction locking hand clamp. Whereas, the device is referred to as a hand clamp throughout, this is not intended as a limitation as to the size or purpose to which the friction locking structure may be employed within the scope of the invention. The clamp comprises two members or clamp arms, one of which may be referred to as the base member and the movement of the other member described, relative to the base member. However, it is to be understood that it is within the scope of the invention to have both clamp arms sliding on the supporting rods.

In accordance with one exemplary embodiment of the invention, the base member is fixed to a pair of slide rods. The rods extend perpendicularly to the base member, and carry an arm member. The arm member is mounted for sliding movement toward and away from the base member by holes in the arm member through which the slide rods are received. Confronting surfaces on the base member and slide member are located beyond the slide rods. In this way, an object, which is engaged by the confronting surfaces, causes a rotation of the clamp arm, and thereby, forces the walls of the holes through the clamp arm into engagement with the slide rods. The surfaces of the holes through the clamp arm are covered with a frictional material, having the characteristic that the material does not substantially deform beyond its elastic limit when left under pressure for a long period of time. A suitable material for this purpose is wood. A wide variety of woods have been tested for this purpose and any wood which is not permanently deformed by the clamping pressures encountered performs in a satisfactory manner. Until recently, most other materials tried would not perform satisfactorily. Particularly cost and manufacturing advantages possible in fabricating the clamp arms from plastics were barred by the lack of appropriate frictional characteristics in the latter materials to maintain the clamping force. Recent investigation and resultant design changes have overcome this shortcoming as exemplified in a second embodiment of the invention. In this latter modification, the clamp arms are made entirely from a plastic containing talc as an additive, to reduce the lubricating characteristics of the plastic, and have special structural features and relationships to accomplish the locking action.

The invention has special advantages when utilized in association with slide rods which do not exceed 15 centimeters in length. Rods of this length permit the user to clamp and release the clamping pressure by the use of a single hand and finger pressure to perform both the clamping and clamp release operations. To clamp an object between the confronting surfaces of the clamping members, the object is placed in position and then the sliding clamp arm is moved to engage the object. Additional force is applied to the slide arm with the force being concentrated between the slide rods, until sufficient force to equal the desired clamping force is obtained. Thereafter, the clamp will hold the desired clamping force over an extended period of time. For example, the clamping force can be maintained for the 24 to 48 hour period required for drying of many glue types. When it is desired to release the clamp, it is only necessary to apply a force to the clamp arms in the direction opposite to that necessary to establish the clamping action, and between the slide rods. This causes a rotation of the clamp arm, opposite to that which caused the frictional engagement, until the frictional engagement is less than that necessary to maintain the clamp arm in position, whereupon the clamp arm slides freely to the limit of its travel.

The invention makes possible a whole family of clamp types which produce a new and improved result. The clamps are relatively low in cost to manufacture and yet produce a reliable sustained and controlled clamping force. The clamps are especially adaptable to single-handed operation, which permits them to be utilized in a situation where the operator's other hand is employed in gripping the parts to be secured.

Other objects and many attendant advantages of the invention will become more apparent upon reading the following detailed description, together with the drawings, in which like reference numerals refer to like parts throughout and in which:

A BRIEF DESCRIPTION OF THE DRAWINGS

DETAILED DESCRIPTION OF THE DRAWINGS

Figure 1:
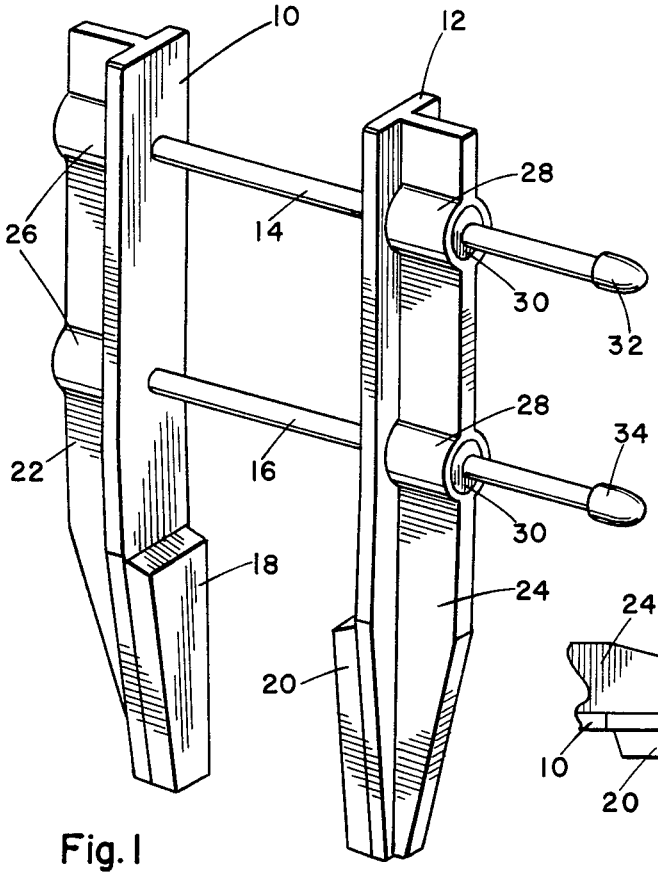
FIG. 1 is a perspective view of one embodiment of the clamp.

Referring now to the drawings, and initially to FIG. 1 thereof, there is illustrated a first embodiment of the hand clamp comprised of the base member and fixed clamp arm 10, the sliding or moveable clamp member 12, and the slide rods 14 and 16. Slide rods 14 and 16 are formed of bar stock with polished surfaces and sized so as not to bend during the clamping action. The base member 10 is fixed to the slide rods 14 and 16 so that the slide rods, 14 and 16 are maintained parallel. The clamp arm 12, is received for sliding movement on the slide rods 14 and 16. Each clamp arm 10 and 12, incorporates confronting surfaces comprising elastic gripping pads 18 and 20. The gripping surfaces are tapered toward their outermost ends to provide access to cramped locations. The clamp arms, 10 and 12, each have similar reinforcing ribs 22 and 24 respectively, and ferrules 26 and 28. In the case of ferrules 26, the only penetration is a bore small enough to receive the rods 14 and 16 in a pressed fit relationship. In the case of the ferrules 28, an enlarged bore from the outer aspect of the clamp arm 12 is provided. In each bore there is received an insert 30. The inserts may be of any suitable friction material, but applicant has found that the use of wood is especially advantageous and produces good sustained clamping effect.

The outer ends of the arms 10 and 12 are angled toward one another at an angle of between one and two degrees of so that in conjunction with the resilient action of pads 18 and 20 an initial clamping force is applied wiht the pad surfaces as nearly parallel as possible. The outermost ends of the rods 14 and 16, are protected by end caps 32 and 34, which protect the user's hand, and particularly the user's palm from the ends of the rods.

Figure 4:
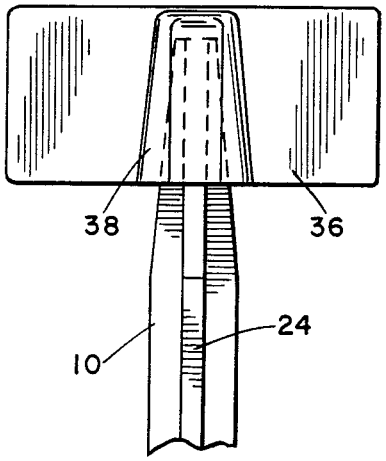
FIG. 4 is a top plan view of a portion of one clamp arm with a wide jaw attachment.

Referring to FIG. 4, there is illustrated a wide jaw attachment 36, which includes a tapered mounting adaptor 38 for engagement with the tapered ends of the clamp arms. With the illustrated configuration, a relatively uniform pressure can be applied over a much larger surface area, than with the standard jaws.

Figure 5:
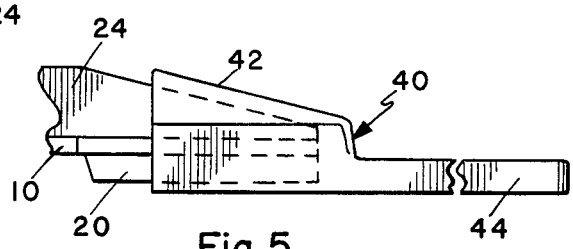
FIG. 5 is a side elevation view of a portion of one clamp arm with an extended finger attachment.
Figure 2:
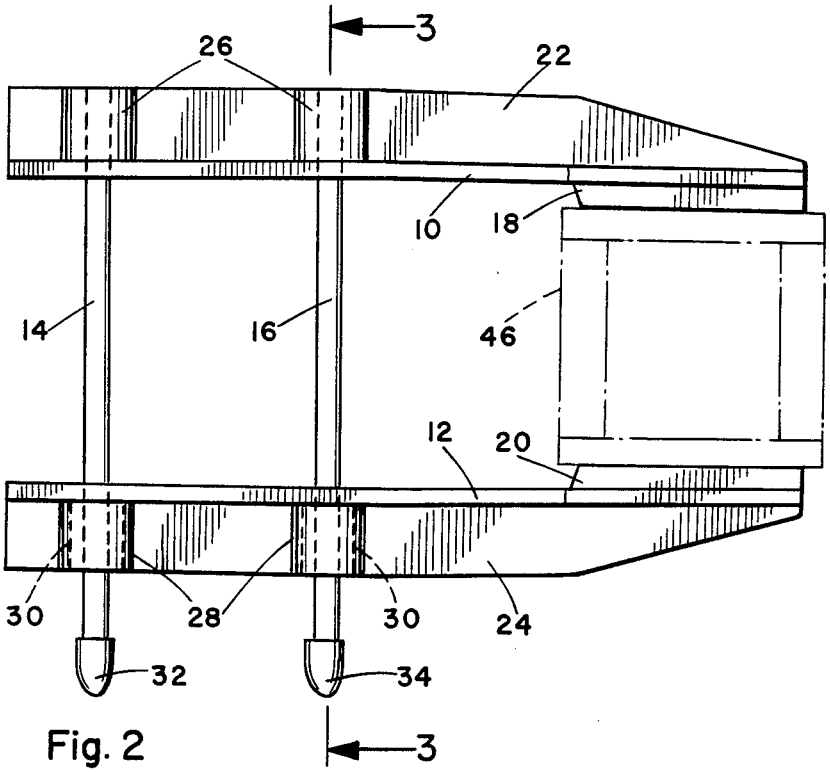
FIG. 2 is a side elevation view of the clamp of FIG. 1 secured on a clamped piece.

Referring to FIG. 5, a further adaption of the subject invention is illustrated. An extender 40 is lodged by engagement with the tapered end of the clamp arms in a socket member 42. The extender includes elongated jaws 44, which permits the jaws to apply a force across a larger longitudinal distance than with the usual configuration.

Figure 6:
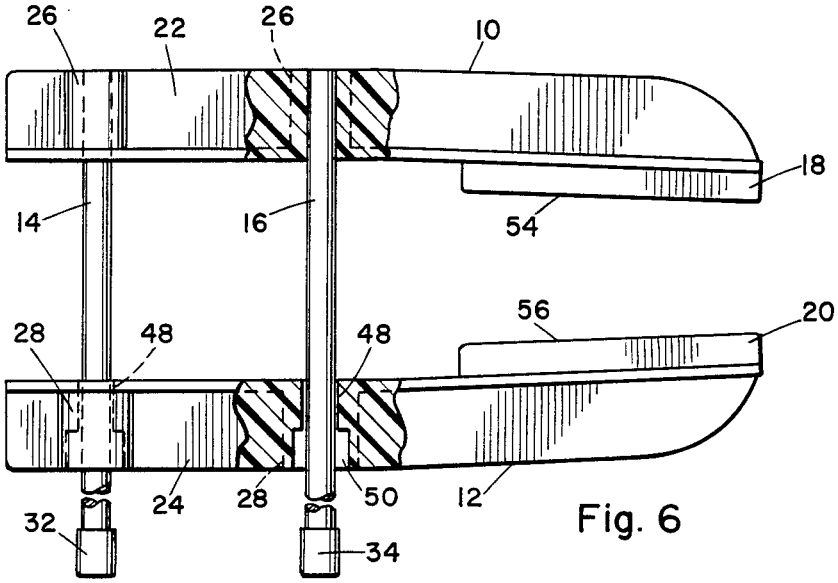
FIG. 6 is a side elevation view, with portions cut away, of a alternative form of the clamp.
Figure 7:
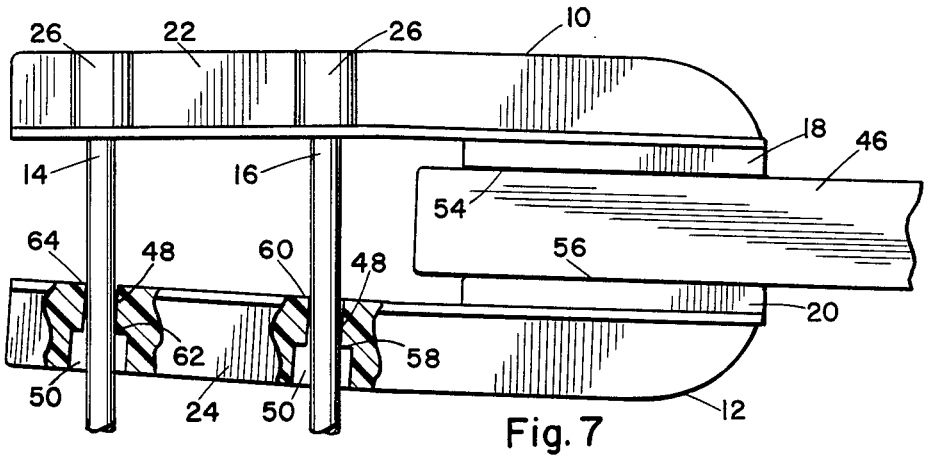
FIG. 7 is a side elevation view of the clamp of FIG. 6 with a work piece secured in the clamp.

FIG. 6 illustrates a second embodiment of the invention which permits the fixed and movable clamp arms 10 and 12 to be formed entirely of plastic, and thus eliminate the need for the wood inserts 30. In this modification of the design, the construction of ferrule 26 remains the same as previously described, but the provisions for mounting the movable clamp arm 12 upon the rods 14 and 16 is altered. Ferrules 28 are formed in the movable arm 12 to have cylindrical bearing surfaces 48 for the rods 14 and 16, and non-bearing countersunk openings 50 to receive end caps 32 and 34. Ferrules 28 have enlarged bores 49 in relation to the diameter of the rods 14 and 16 to permit a loose fit of the bearing surfaces 48 upon the rods when the contact pads 18 and 20 are not engaging a work piece. The length of the bearing surfaces 48 and the clearance of the bores 49 are such as to permit an angular rotation of the movable clamp arm 12 about the rods equal to the sum of the angles of inclination of the upper portions of arms 10 and 12 toward one another. As illustrated in FIG. 7, such a relationship results in the surfaces 54 and 56 of pads 18 and 20 being parallel when they are brought into contact with a work piece 46 in clamping. In the exemplary embodiment, the rods 14 and 16 are 0.1875 inches in diameter, the length of the bearing surfaces 48 anre $\frac{3}{8}$ths of an inch, and the bore 49 clearance is 0.0015 inches. This configuration permits a 4 degree rotation of the arm 12 about the rods 14 and 16 upon its initial contact with work piece 46 which is equal to the combine angular inclination of the arms 10 and 12 toward each other. As a consequence, when the arms 10 and 12 are brought into contact with work piece 46, the pad surfaces 54 and 56 are parallel. Also upon contact with the work piece, the bearing surfaces 48 of the movable arm 12 engage the rods 14 and 16 at four locations 58, 60, 62, and 64 to initiate the locking of arm 12 upon the rods as illustrated in FIG. 7. For clamps of the size illustrated, it has been found that the length of the bearing surfaces 48 may vary between one-quarter and three-eighths of an an inch. Below the lower limit, the initial locking angle becomes too large to maintain the clamp action, while bearing surfaces of greater than the maximum length given do not permit sufficient rotation of the arm 12 to permit the clamping.

Figure 8:
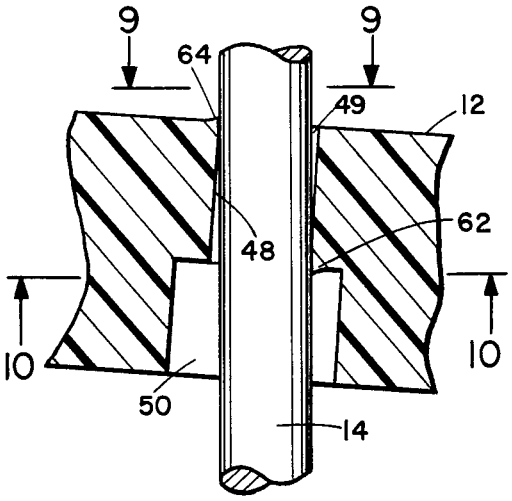
FIG. 8 is an enlarged view similar to a portion of FIG. 7 showing the clamping action.
Figure 9:
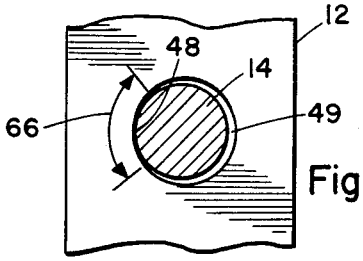
FIG. 9 is a sectional view taken on line 9—9 of FIG. 8.
Figure 10:
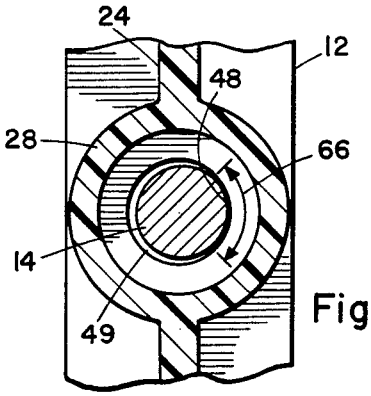
FIG. 10 is a sectional view taken on line 10—10 of FIG. 8.

The smaller diameter of rods 14 and 16 in relation to the bore 49 ensures establishment of effective frictional contact at surfaces 66 between the bearing surfaces 48 and the rods as illustrated in FIGS. 8, 9, and 10. Application of increased clamping pressure between the fixed and movable arm causes the hand clamp to grip the work piece 46 tighter, and at the same time further increases the locking angle and force of arm 12 on rods 14 and 16 while maintaining the parallel relationship of the gripping surfaces 54 and 56. Release of the clamp illustrated in FIGS. 6 and 7 is achieved as previously described in conjunction with the first embodiment.

It has been found that the use of wood inserts 30 permits reliable clamping pressure to be obtained, even though the slide rods 14 and 16 have smooth outer surfaces. The use of a polished metal finish is preferred because it permits the slide arm to move easily when clamping pressures are required, and until engagement with the article to be clamp is established. The previously encountered lack of sufficient frictional characteristics in plastic materials to maintain the lock of arm 12 to rods 14 and 16 for prolonged periods of time has been overcome by the use of plastics containing a talc additive in conjunction with the locking structure described for the second embodiment. The latter clamp arms are formed of polypropylene containing 30 percent talc by weight but a range of 30 to 45 percent talc in various plastic materials has been found to be satisfactory. It should be noted that the clamping action of the invention does not require flexing of the rods 14 and 16, but rather depends on their rigidity, and therefore, rods may be utilized that they have sufficient strength to stand the highest clamping forces anticipated.

Figure 3:
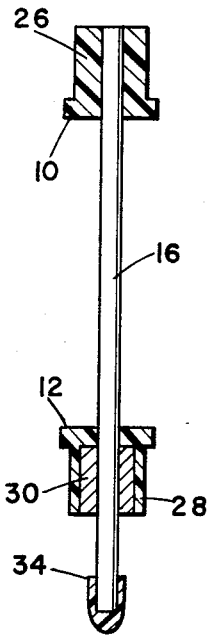
FIG. 3 is a sectional view taken on line 3—3 of FIG. 2.

For maximum effect, the slide rods should be spaced by a substantial distance so that there is sufficient strength to resist permanent deformation from the clamping forces. At the same time, the clamp jaws should extend well beyond the adjacent, or innermost, slide rod so that there is sufficient leverage to cause a rotation upon clamping to induce the frictional binding clamping action on the work piece 46, as illustrated in FIGS. 3 and 7. It has been found that the clamping action desired can be obtained at a lesser distance, but that the best results are obtained when the outermost part of the clamping surfaces is twice as far from the innermost rod, as the distance between the innermost and the outermost rods, but no more than four times as far.

Having described my invention, I now claim:

1. A friction locking hand clamp for objects, comprising:

a plastic base member, a plastic arm member, a pair of rigid rods, said base member and said arm member having substantially identical elongated planar confronting surfaces, said confronting surfaces having correspondingly positioned holes therethrough for receiving said rods, and object clamping portions extending beyond the holes;

said object clamping portions being inclined toward one another;

reinforcing means for providing strength and rigidity to said base member and said arm member confronting surfaces;

said base member reinforcing means including means in cooperative relationship with said base member holes for securing the first ends of said rods in said base member in a parallel spaced relationship;

said arm member reinforcing means including bearing means in cooperative relationship with said arm member holes for permitting slidable movement of said arm member on said rods and rotation of said arm member on said rods equal to the combined angular inclination of said clamping portions toward one another;

means mountable on the second ends of said rods for preventing the removal of said arm member from said rods and protecting the hand of the clamp user from injury by said rod ends, said preventor and protection means being in cooperative operational relationship with said arm member bearing means to permit maximum opening of the clamp, and means for increasing the frictional characteristics of said base member and said arm member.

2. A frictional locking hand clamp as recited in claim 1 wherein said reinforcing means comprises:

ribs formed in said base member and said arm member spaced along the length of said members behind said confronting surfaces.

3. A friction locking hand clamp as recited in claim 2 wherein:

said base member reinforcing rib includes ferrules formed as extensions of said rod receiving holes.

4. A friction locking hand clamp as recited in claim 2 wherein said arm member reinforcing rib includes:

ferrules formed as extensions of said rod receiving holes to form a bearing with the wall of said holes and ferrules acting as bearing surfaces for said rods, and having a non-bearing countersunk portion for receiving said preventor and protection means.

5. A friction locking hand clamp as recited in claim 1 wherein the means for increasing the frictional characteristics of said base and arm members comprises:

forming said base member and said arm member of polyethelene plastic containing 30 to 45 percent talc by weight.

6. A friction locking hand clamp for objects comprising:

a pair of rigid spaced parallel rods secured at one end in a base member and having end caps covering the opposite ends of said rods;

a plastic arm member slidably carried on said rods for movement toward and away from said base member;

said rods being receivied in holes through said arm member with the walls of said holes acting as bearing surfaces for said rod;

said base member and said arm member having indentically formed confronting surfaces including elongated planar portions backed by reinforcing ribs and inclined toward one another along the length of said planar portions beyond said rods;

elastic pads positionable on said confronting surfaces to engage the object to be clamped;

said arm member holes having a diameter and a wall length along said rods sized to allow rotation of said arm member about said rods and to grip said rods when said pads engage the object;

said arm member holes having non-bearing countersunk portions for receiving said end caps when the clamp is fully opened.

* * * * *

UNITED STATES PATENT AND TRADEMARK OFFICE

CERTIFICATE OF CORRECTION

PATENT NO. : 4,555,100

DATED : November 26, 1985

INVENTOR(S) : JOSEPH R. DITTO

It is certified that error appears in the above-identified patent and that said Letters Patent is hereby corrected as shown below:

Column 6, line 41, Claim 6, change "receivied" to --received--.

Column 6, line 44, Claim 6, change "indentically" to --identically--.

Signed and Sealed this

*Sixth* Day of *May 1986*

[SEAL]

*Attest:*

DONALD J. QUIGG

*Attesting Officer*

*Commissioner of Patents and Trademarks*